United States Patent [19]

Vultaggio et al.

[11] Patent Number: 4,885,434

[45] Date of Patent: Dec. 5, 1989

[54] AUTOMOTIVE HEADLIGHT, PUSH-PULL, ROTARY SWITCH SYSTEM

[75] Inventors: Anthony Vultaggio, Warren; David A. Coffin, Novi, both of Mich.

[73] Assignee: United Technologies Automotive Inc., Dearborn, Mich.

[21] Appl. No.: 193,017

[22] Filed: May 12, 1988

[51] Int. Cl.[4] ..... H01H 9/00

[52] U.S. Cl. ..... 200/4; 200/291; 338/172

[58] Field of Search ..... 200/4, 291; 338/172

[56] References Cited

U.S. PATENT DOCUMENTS

| | | | |
|---|---|---|---|
| 2,942,220 | 6/1960 | Elliott et al. | 338/172 |
| 3,840,838 | 10/1974 | Tanaka et al. | 338/198 |
| 4,081,782 | 3/1978 | Hildreth et al. | 338/200 |
| 4,117,444 | 9/1978 | Hildreth et al. | 338/198 |
| 4,682,142 | 7/1987 | Lohner et al. | 338/172 |
| 4,692,805 | 9/1987 | Lopez et al. | 338/198 |

*Primary Examiner*—A. D. Pellinen
*Assistant Examiner*—Morris Ginsburg

[57] ABSTRACT

A composite, push-pull headlight and rotary switch (1) having a front bracket area (4) and a panel light dimming rheostat (62/91) for use in a vehicle with, for example, a dome light switch and a supplemental fluorescent panel light system switch, utilizing two, parallel, spaced panels (6 & 7) having three, laterally extended, operative planar surfaces, all located in the front bracket area. The front panel (6) has on its back side a rheostat planar surface including a series of circularly disposed, peripherally spaced, resistive layers (62), which, in conjunction with a rotatable, sweeping, rheostat contactor arm (91), serve the rheostat dimming function for the panel lights. The rear panel (7) has on its front side (71) a detent planar surface having three protrusions (72A–72C), which serve as detent positions in cooperation with a flexible, rotatable detent arm (92) sweeping across it, as the control knob shaft (8) is rotated, along with an axially extended and movable, protruding plunger (73), which also extends to the other side (74) of the panel to coact with switch contactors (75A & 75B) for the "dome" light bypass circuit, and a switch circuit planar surface on the opposite, back side having spaced conductive surface contacts (76& 77) which control the main "dome" light circuit and the fluorescent panel light circuit. A common hub (90) carries the rheostat contactor arm and the detent and plunger actuator arm, while on the other side of the second panel there is included a conjunctively rotatable dome & fluorescent contactor structure (93) scrubbing against the switch circuit planar surface.

15 Claims, 7 Drawing Sheets

AUTOMOTIVE HEADLIGHT, PUSH-PULL, ROTARY SWITCH SYSTEM

TECHNICAL FIELD

The present invention relates to automotive electrical switches and more particularly to a combined push-pull and rotary switch specifically designed for turning a headlight "off" and "on" in a push-pull manner in a vehicle, as well as for controlling a number of other electrical functions by rotating the push-pull control knob, including not only, as is standard, the brightness of the panel lights, but also such additional electrical functions as, for example, an "off" switch for the vehicle's "dome" light and the actuation of a supplemental circuit, for example a supplemental fluorescent panel light.

BACKGROUND ART

It is common practice in the automotive art to include in the vehicle's instrument panel, typically to the left of the steering wheel, a headlight switch (with a buzzer circuit) for turning the parking and headlights "on" and "off" by means of a longitudinal pulling or pushing action, respectively, which switch is also combined with a rheostat for dimming or brightening the panel lights on the dashboard by a circular, twisting or rotary motion, to a final clockwise position completely turning them off.

Likewise, this switching structure more recently has been used as well to turn another light "on" and "off," such as, for example, the interior dome light. The function of the dome light switch is to, for example, turn off the dome light circuit, when one or more of the vehicle's doors or tailgate is open during day light hours, by rotating the shaft of the overall switch to the extreme clockwise position (as viewed from the front).

It has been the further practice to have the basic composite switch integrated in its design and occupy a relatively limited and particularly sized space with standardized mounting brackets located in particular locations, so that the composite switch can be mounted in a number of different cars within a car maker's line(s).

In the prior art design, particularly for example in the "Chrysler" switch for this purpose, the supplemental "on"/"off" switch for the dome light was mounted on the side, exterior of the otherwise in-line construction, with the prior art switch having an exposed arm extending generally longitudinally and parallel to the center axis of the switch with its front end bent inwardly to position its distal tip adjacent to the side of the rheostat, so that a projection on the rheostat would cause the switch arm to be moved, breaking the normal electrical contact within the switch.

Such a design added to the bulk of the main switch body and caused significant alignment problems. Additionally, by extending off of the side of the main body of the switch, the dome light switch became more vulnerable to damage in the handling and assembling of the basic switch body into the vehicle. Sometimes the exposed switch arm became bent or misaligned, failing to thereafter engage the rheostat, causing the switching function to no longer be operative.

It additionally had excessive tolerance stack-ups on component parts. Also, the switch arm required ultrasonic welding between it and its associated terminal, a relatively difficult process.

For further background information on an alternate resolution to this problem, reference is had to assignee's co-pending U.S. patent application Ser. No. 07/116,085 of William M. Riser et al filed Nov. 3, 1987, entitled "Combined, In-Line Spacer and Switch, Particularly for A Vehicle's Light," issued as U.S. Pat. No. 4,827,241 on May 2, 1989, the disclosure of which is incorporated herein by reference.

Additionally, recently it has also become desirable to have the rotary action of the same switch control a supplemental fluorescent light circuit for brightening the panel in day light situations. This additional function further adds to the possibility of greater bulk to the switch.

DISCLOSURE OF INVENTION

The present invention in its preferred embodiment is designed to replace the previous outboard, dome light switch and to further include another electrical function, namely, for example, a fluorescent panel light switch, with an in-line, highly compact and reliable, relatively inexpensive, rotatable, multi-function switching structure of preferably multi-spaced-panel construction, all of which is positioned and located centrally in-line in the front bracket area previously occupied by a ceramic rheostat and a spacer at the front area of the composite switch structure, with none of the switches located outboard of the main body of the in-line composite switch.

Thus, the present invention, in its supplemental switching structures, does not add at all to the overall exterior bulk of the basic, composite rotary & push-pull basic switch structure.

Additionally, by being mounted centrally in-line, the switching structures are actuated by the rotation of the shaft upon which the other rotary parts of the composite switch are mounted, providing it with a direct drive, avoiding any dependency on, for example, mechanically interfacing an elongated exposed arm on the switch with a physical protrusion on the rheostat's surface.

Additionally, the present invention in its preferred embodiment, not only provides the "on"/"off" switch function for a vehicle light, such as for example the dome light, but also provides in the same central, frontal area a switching circuit for another electrical function, particularly, for example, a supplemental fluorescent panel lighting system.

The preferred, exemplary embodiment achieves all of this by utilizing two, spaced, parallel, facing panels having three, spaced, parallel, flat, laterally extended, operative planar surfaces— a first, front panel having on its rearwardly facing side a rheostat planar surface including a series of circularly disposed, peripherally spaced, resistive layers, which, in conjunction with a rotatable rheostat contactor arm, serve the rheostat dimming function for the panel lights., a second, rear panel, having on its side facing the first panel, a detent planar surface including a series of raised protrusions (for example, three), which serve as detent positions in cooperation with a scrubbing, flexible, rotatable arm sweeping across it, as the central control knob and shaft are rotated, along with an axially extended and movable, protruding plunger, which also extends to the other side of the panel to coact with the switch contactors for, for example, a "dome" light bypass circuit, and a switch circuit planar surface on the opposite side of the second panel having spaced conductive surfaces and contacts which control, for example, the "dome" light bypass circuit and the fluorescent panel light circuit.

In conjunction with the two spaced panels, there is included between the two panels on a common hub the rheostat contactor arm scrubbing against the rheostat planar surface and the detent and plunger actuator arm scrubbing against the opposed, detent plane; while on the other side of the second panel there is included a rotatable dome & fluorescent contactor structure scrubbing against the switch circuit plane. The latter contactor structure is rotated conjunctively with but electrically isolated from the rheostat contactor arm, and the detent and plunger actuator arm does not need to conduct any electricity.

It is noted that the three planar surfaces are to some degree relatively reversible, that is, for example, the detent planar surface and the switch circuit planar surface could be reversed or, for further example, the rheostat planar surface could be switched with the detent planar surface, with the rheostat arm appropriately re-configured to also cooperate with and actuate the "dome" switch plunger. In fact, for enhanced compactness, two and perhaps even all three planar surfaces could be combined on the same side of a single panel. Thus, for example, the detent protrusions could be provided on either the rheostat or the switch circuit surfaces, with the actuator arm being combined with the rheostat arm or the rotatable switching structure. Additionally, by using a different switching mechanism other than a through-the-panel plunger, both of the rotatable arms and the rotatable switching structure could be combined together to sweep across the same panel side, with all of the detent protrusions, circuit pads and contacts and all of the rheostat resistive layers appropriately laid out on it, with the contact portions for each of the rotatable members using different radii of revolution in order not to interfere with one another.

Thus, the present invention provides, in conjunction with the push-pull headlight switch, a highly compact, functionally increased, multi-function, rotary switching structure controlling, for example, the brightness of the panel light, a "dome" main and a "dome" bypass circuit and a supplemental fluorescent circuit, all in the same space previously occupied by the ceramic rheostat and a spacer in the rotary, push-pull headlight switch of the prior art, all with no switches hanging off of the side of the main body of the rotary switch body. For a further understanding of this achievement over the prior art, it is noted that the ceramic rheostat and the "out board" dome switch of the prior art are illustrated as elements 3 & 6, respectively, in FIGS. 1A & 1B of the Riser et al co-pending application referred to above, while the prior art, spacer is illustrated as element 5 in FIGS. 2A & 2B thereof.

The foregoing and other features and advantages of the present invention will become more apparent from the following further description and drawings.

BRIEF DESCRIPTION OF DRAWINGS

FIGS. 1, 2 & 3 are front, top and side views, respectively, of the overall headlight switch with buzzer circuit assembly, including the preferred embodiment of the rotary, in-line, multi-spaced-panel switching structure for the panel light brightness, the electrical dome light switch and the fluorescent light switch, all located in the front, central bracket portion of the basic composite switch body; while

FIG. 5 is a plan view of the rheostat planar surface on the rear side of the front panel located in the front, central portion of the overall switch structure illustrated in FIGS. 1–3; while FIG. 6 is a plan view of the switch circuit planar surface on the rear side of the rear panel, with the detent planar surface being located on the other, front side of the rear panel, which, along with the front panel of FIG. 5, is located in the, front, central portion of the overall switch structure illustrated in FIGS. 1–3; while

Figure 5:
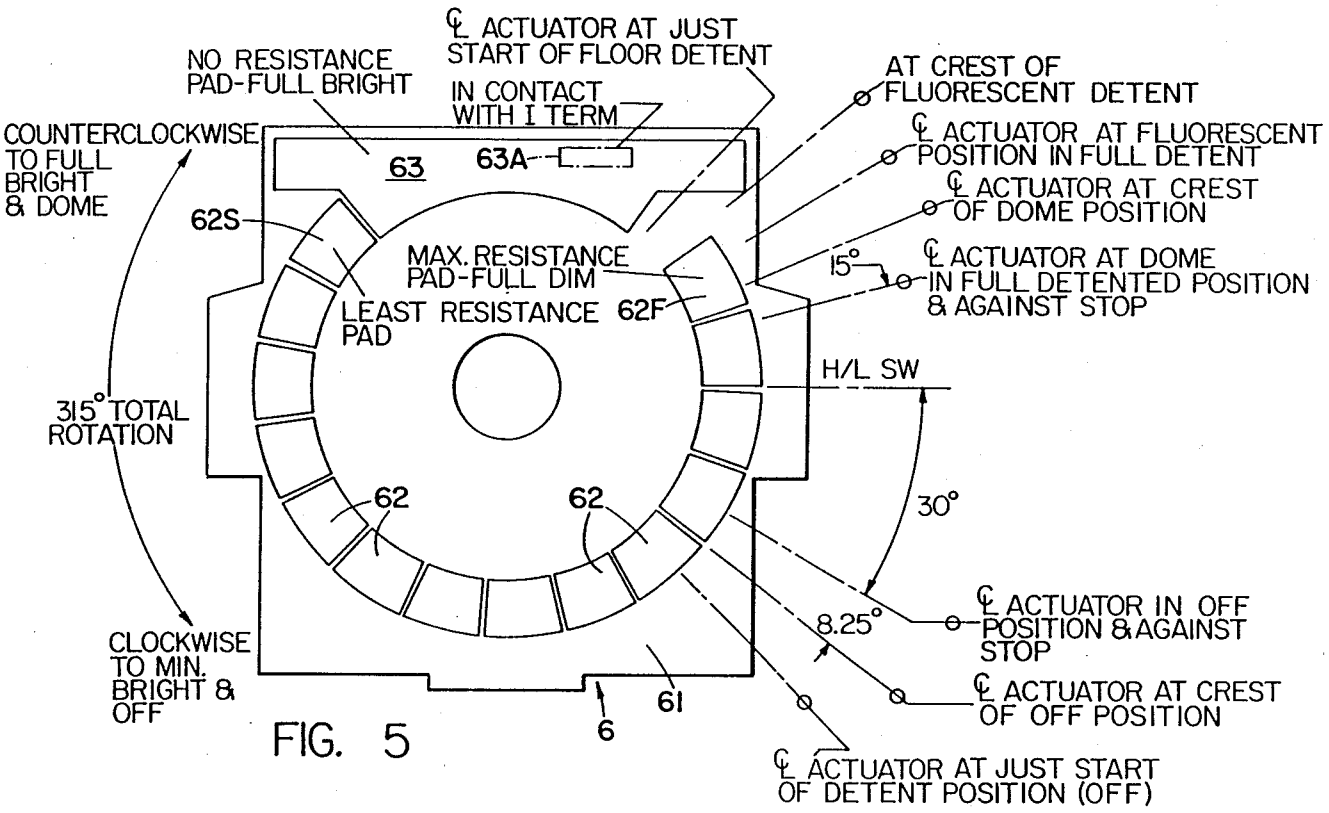
Figure 6:
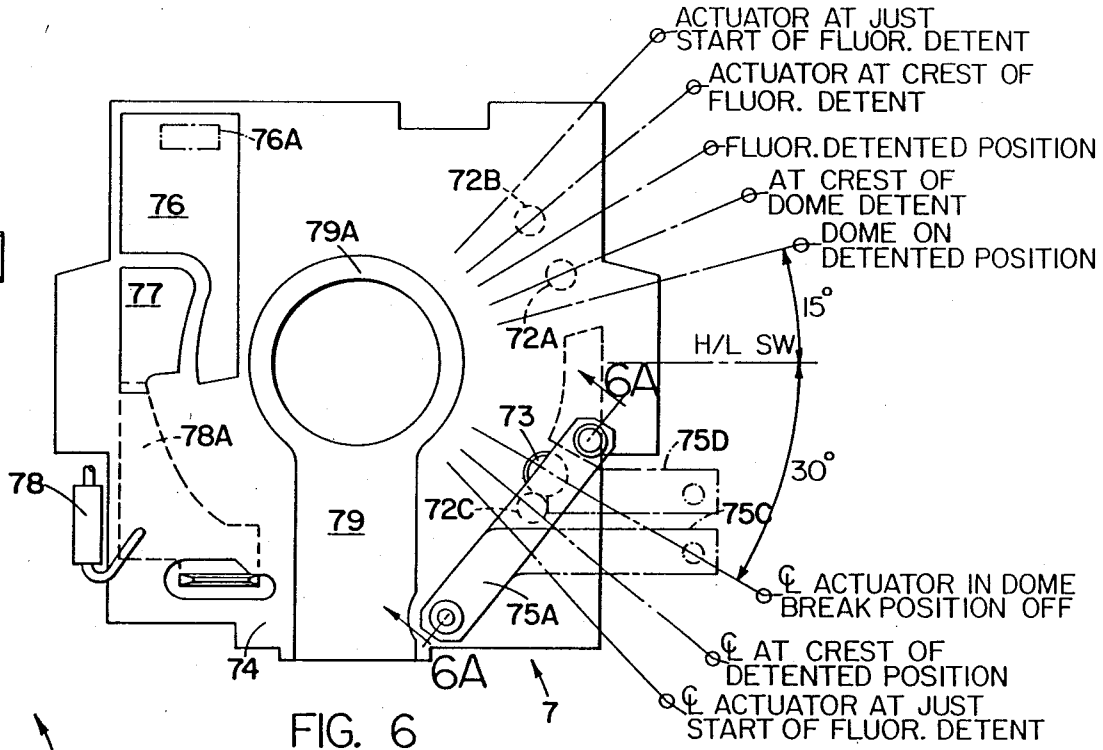
Figure 7:
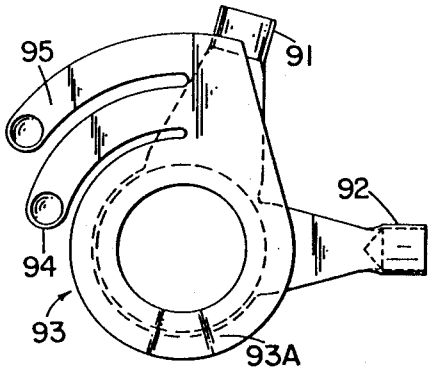
FIG. 7 is a plan view of the rotatable hub structure carrying the rheostat contactor arm and the detent arm combined with the rotatable dome & fluorescent contactor structure behind it, with the second, rear panel of FIG. 6, which would normally separate them, not being illustrated in order that both structures can be seen together to show their relative positions, as the two structures are rotated together.

It is noted that FIGS. 5–6 are generally drawn to the same relative scale, so that the rotatable structure of FIG. 7 could be placed on top of FIG. 5 and/or 6 with their central points coincident to allow the relative locations of the various sub-elements to be viewed, as the structure of FIG. 7 is rotated about a central axis orthogonally coming out of the plane of the paper at the coincident central points, relative to the panels of the other two figures.

Figure 8:
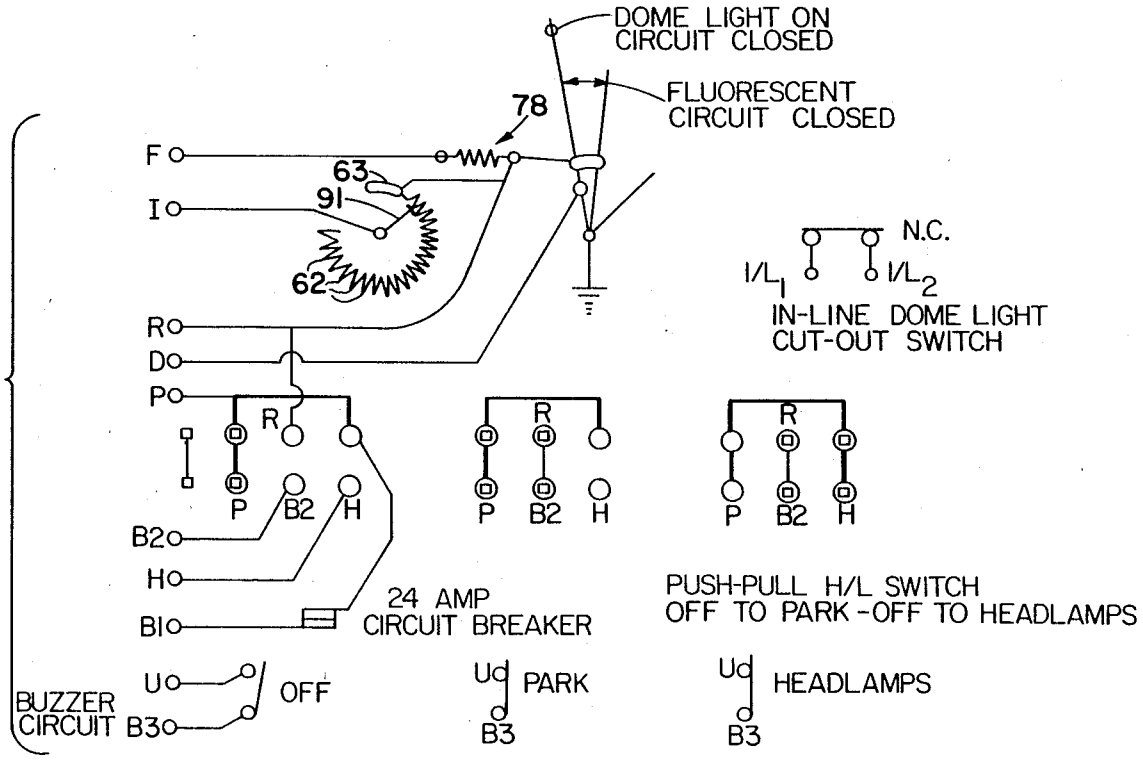

FIG. 8 is an electrical schematic view of the overall electrical circuit diagram of the headlight switch with buzzer circuit, including the rheostat, fluorescent light switching and the dome "on"/"off" switching functions performed by the multi-spaced-panel and rotary structures of FIGS. 5–7, with the rotary elements being positioned for the panel lights being partially dimmed, the "dome" light "on" circuit closed, and the fluorescent light circuit "off."

Figure 9:
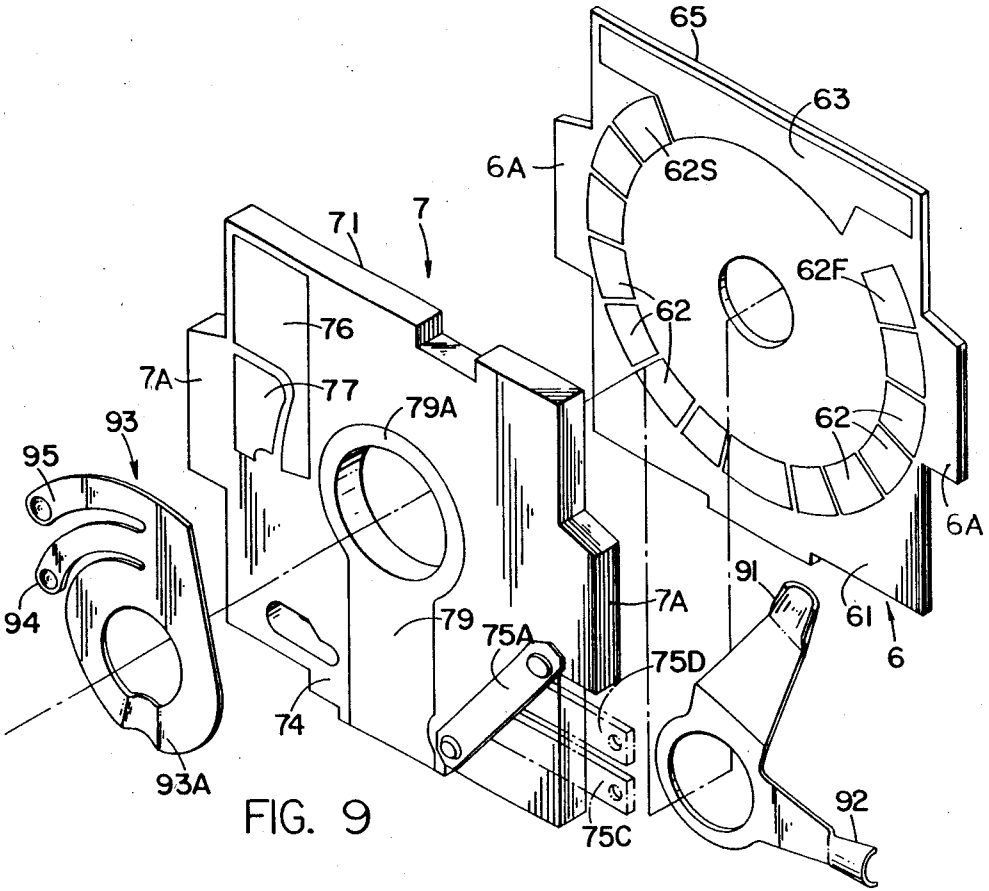

FIG. 9 is a rear perspective, exploded view of the two panels of FIGS. 5 & 6 and the conjunctively rotated structures of FIG. 7, showing their relative positions and the relative alignments of their various sub-elements.

BEST MODE FOR CARRYING OUT THE INVENTION

Figure 1A:
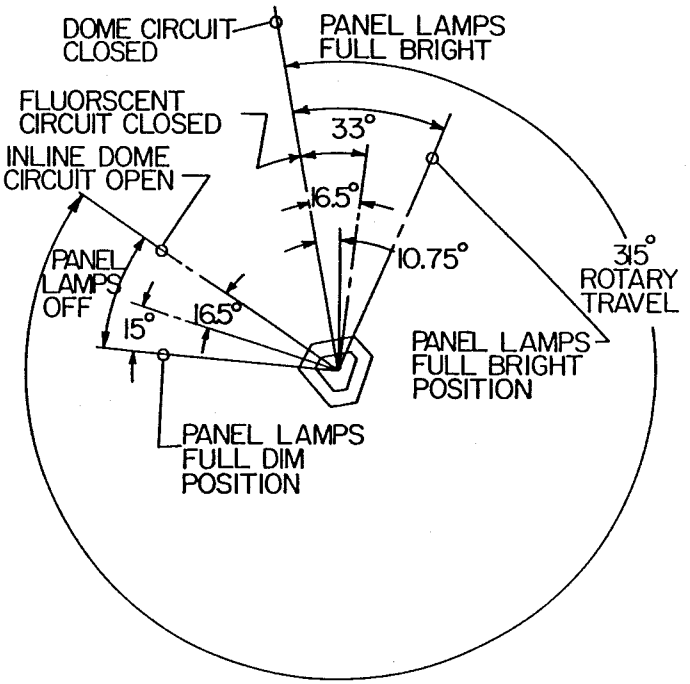
FIG. 1A is a diagram illustrating the relative rotary positions at which the various electrical functions are performed, when the switch is viewed from the perspective of FIG. 1, as the central shaft is rotated by the user in a clockwise direction.
Figure 1:
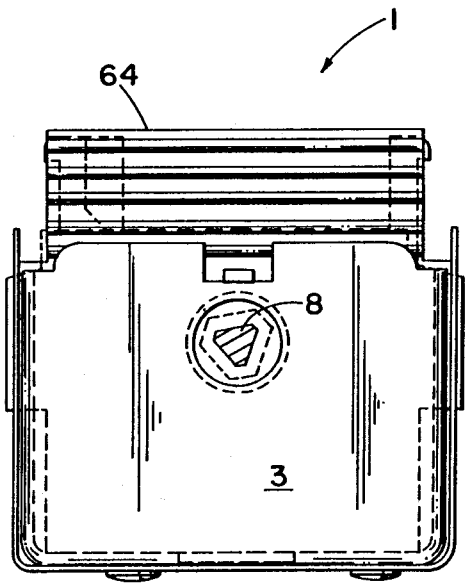
Figure 2:
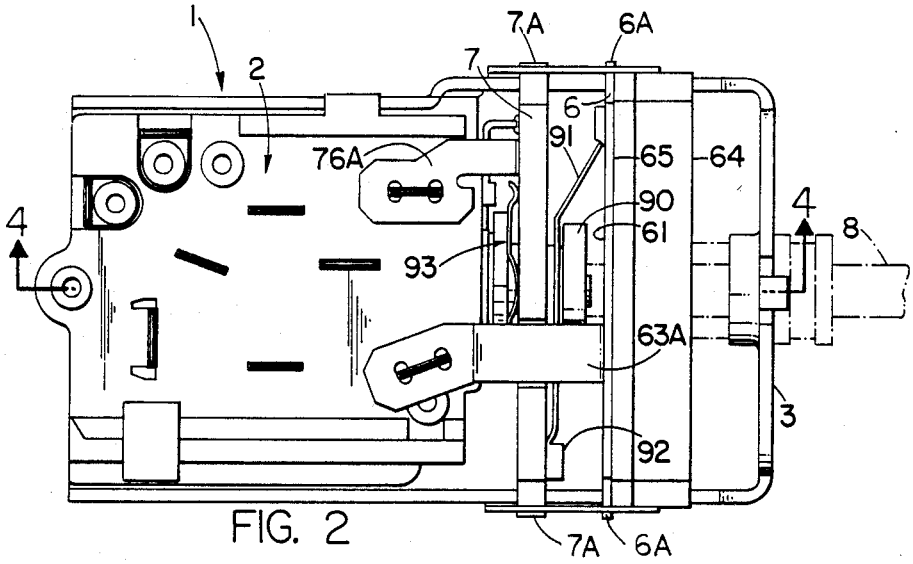
Figure 3:
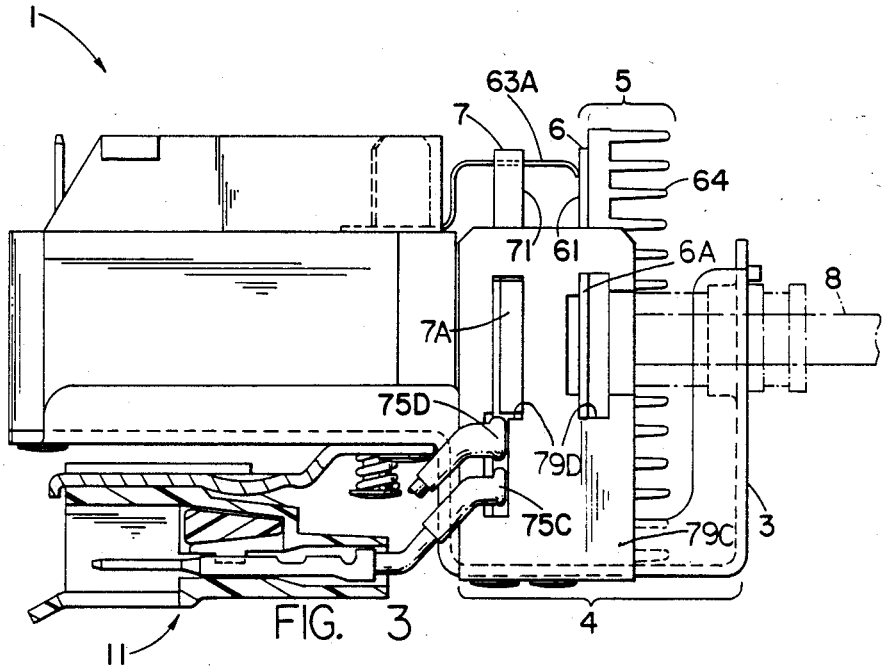

As can be seen in FIGS. 1–3, the overall, composite headlight switch 1 (with buzzer circuit) includes two basic components, the main electrical switching component 2 and the front bracket 3 defining a front bracket area 4. These components can be and preferably are identical to those used in the prior art. The internal structure and the terminal pin layout for the prior art switching component 2 can be seen in FIGS. 4 & 2, respectively.

Within the front bracket area 4 are included the rheostat 5 and the switch components for the "dome" light bypass circuit and the supplemental fluorescent panel light, as explained more fully below, all contained on or affiliated with two, parallel, spaced panels 6 & 7. The front bracket area 4 typically has a longitudinal dimension of about one and a fourth inches in its depth, while the panels 6 & 7 can have exemplary thicknesses of, for example, of the order of a thirty-second of an inch and an eighth of an inch, respectively, with the entire novel switch components made up of the panels 6 & 7 and their attendant central components, including the heat sink 64, having a combined exemplary thickness or depth of about one inch, still leaving a significant amount of space in front of the heat sink 64, as can best be seen in FIGS. 2 & 4.

In the prior art switch, an electrically-non-functional spacer (note element 5 of FIGS. 2A & 2B of the Riser et al application) was located in the front area 4 of the overall composite switch structure 1, while the prior art dome light switch (note phantom lined box 6 in FIGS. 1A & 1B of the Riser et al application) was located outboard of the main body I of the switch, hanging off of its side in piggy-back fashion.

However, in the preferred embodiment of the present invention, the dome "on"/"off" switch is located within the front area 4, and, in this same area, is also located the switch for the supplemental fluorescent light circuit, all as explained more fully below. Each of these switches, as well as the rheostat 5, are actuated and controlled through the rotation of the central control shaft 8 as part of the rotary switch structure.

The two, parallel, spaced, facing panels 6 & 7, which are substantially flat over most of their main sides, include three, laterally extended, operative planar surfaces, all located within the front bracket area 4.

The front panel 6, made primarily of electrically insulating material, has on its back side 61 a rheostat planar surface (shown in plan view in FIG. 5), including a series of circularly disposed, peripherally spaced, resistive layers 62, which, in conjunction with a rotatable rheostat contactor arm 91, provide the rheostat dimming function for the panel lights, as the rotary shaft 8 is rotated in a clockwise direction. A beginning, "no resistance" layer 63 is included at the top side of the panel 6 which provides a "full bright" initial contact area for the rheostat arm 91, with the associated contact surface member 63A being connected to the "I" terminal.

As the initial resistive layer 62S, providing an initial minimum resistance and dimming, is contacted and passed in a clockwise direction (from the perspective of the user), additional resistance is added into the main panel light circuit by subsequent resistive layers 62, causing the main panel lights to further dim. When the rheostat arm 91 passes the last, maximum resistance, "full dim" layer 62F, it then rests on the electrically insulating surface of the main body of the panel 6, effectively cutting off the main panel lights.

A laterally extended heat sink 64 is attached to the front side 65 of the panel 6 to dissipate the heat generated by the resistive layers 62 during the main panel light dimming function. Although this type of stationary, flat rheostat panel structure 6 is preferred for use in the present invention, the ceramic rotatable rheostat body (note element 5 of the Riser et al application) could be used if desired.

The rear panel 7 has on its front side 71 facing the first panel 6, a generally flat, detent planar surface having, for example, three raised, circular protrusions or bosses 72A, 72B & 72C (note FIG. 6), which serve as detent positions in cooperation with a flexible, rotatable detent arm 92 sweeping across them and the front side 71, as the control knob rod 8 is rotated. The initial detent protrusion 72A (the lower side of which represents the starting position) serves to indicate or bracket the position of the "dome" light being "on," at which point the "dome" circuit is closed, while detent protrusion 72B with the protrusion 72A brackets the positions for the supplemental fluorescent circuit actuation being "on." The final detent protrusion 72C indicates the entrance position of the "dome" light bypass cut off, which causes the "dome" circuit to be bypassed even if a vehicle door is open, as well as the main panel light "off" position.

The second panel 7 also includes an axially extended and movable plunger 73 (note also FIG. 6A), which normally protrudes out past the front side 71, but also extends to the other, rear side 74 of the panel 7 to coact with relatively movable, switch contactors 75A & 75B for the "dome" light override circuit. As can be seen best in FIGS. 3 & 6, the distal, associated ends 75C & 75D of the relatively movable contactors 75A & 75B, respectively, extend out from the sides of the front bracket area 4 defined by the bracket 3 for connection into the supplemental connector housing 11 for connection into the in-line dome terminals of the electrical circuitry of the vehicle.

As can best be seen in FIG. 6, the rear side 74 of the rear panel 7, which is primarily made of an electrically insulating material with various conductive pads of, for example, copper plate added, includes switch circuit planar surface forming the "dome" and fluorescent circuit board. The circuit elements include the spaced, conductive surfaces 76 & 77, which control the main "dome" light circuit and the supplemental fluorescent panel light circuit in conjunction with the "dome" and fluorescent contactor arms, as well as the movable, conductive contacts 75A & 75B, which control the "dome" light bypass circuit in conjunction with the movement of the plunger 73.

The conductive surface 76 forms a dome circuit pad, which is in electrical contact with the "D" terminal through connector 76A, while the conductive surface 77 forms a fluorescent circuit pad electrically connected to the "F" terminal by the internal conductive pad 78A. As can be seen in the lower, right hand side of FIG. 6, a resistor 78 (e.g. one K ohm, quarter watt) is included in line from the conductive pad 78A from the "F" terminal to the "R" terminal, which feeds the panel lights.

Figure 4:
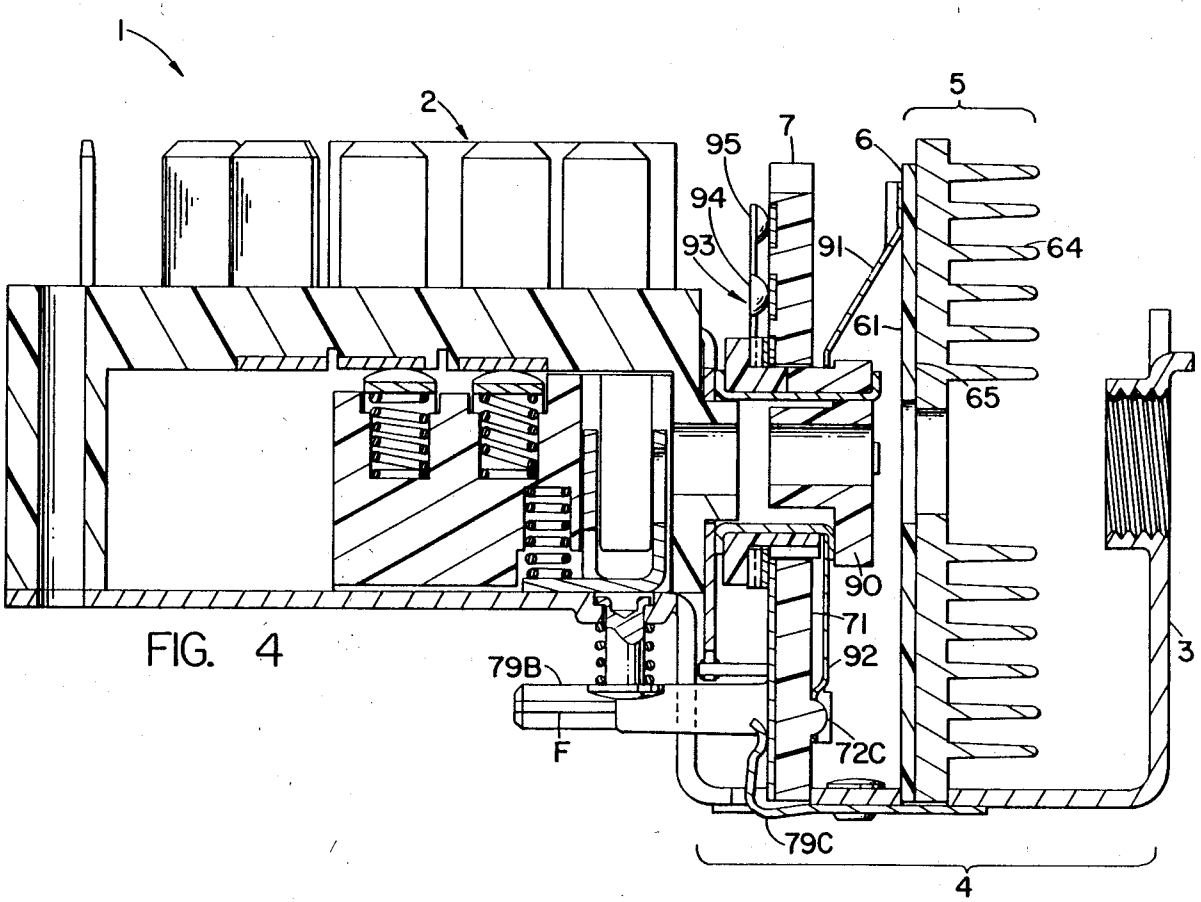
FIG. 4 is a side, cross-sectional view of the embodiment of FIGS. 1–3, taken along section line 4—4 of FIG. 2.

A "ground" conductive pad 79 extends from around the central hub area 79A to the lower edge of the board panel 7 and is in electrical connection with the standard "ground" terminal 79B (note FIG. 4). As can be best seen in FIGS. 3 & 4, a supplemental, longitudinally extended, "U" shaped, conductive holder 79C grounds the conductive pad 79 to the bracket 3 and the ground terminal 79B. The holder 79C, which is affixed to the bracket 3 by, for example, rivets, also has side, female slots 79D in it, into which laterally extending, side, male tabs 6A & 7A on the panels 6 & 7, respectively, are inserted (note particularly FIGS. 2 & 3 7 9), for likewise mechanically affixing the panels to the bracket 3. Since the main bodies of the panels 6 & 7, particularly the side tabs, are of electrically insulating material, this interfacing does not ground out the various electrical components or pads on the panels.

In conjunction with the two, spaced, facing panels 6 & 7 and with reference particularly to FIGS. 4 & 7, there is included between the two panels on a common hub 90 of electrically insulating material the radially extending, rheostat contactor arm 91 scrubbing against the rheostat planar surface 61 and the radially extending, detent and plunger actuator arm 92 scrubbing against the opposed detent planar surface 71. The rotatable arms 91 & 92 are both flexible and bear against their respective operative surfaces with a flexible force in opposite longitudinal directions. The actuator arm 92 does not serve to conduct electricity and can be made either of conductive or nonconductive material. Its function is primarily mechanical, serving as a detent "clicker" in conjunction with the buss protrusions 72A–C, and to mechanically break or open the circuit formed between the contacts 75A & 75B.

Figure 6A:
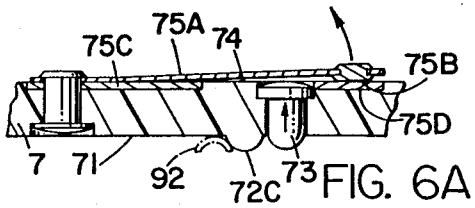
FIG. 6A is a side, cross-sectional, partial view (taken along section line 6A—6A of FIG. 6) of that peripheral portion of the rear panel which includes the "dome" light circuit, plunger, which breaks the circuit when depressed from the detent planar surface side of the rear panel.

As can be best visualized in connection with FIGS. 6 & 6A, this latter function occurs during the course of its end rotation, when it contacts, bears down against and depresses the plunger 73 after it passes the detent buss 72C, which plunger in turn pushes the flexible contact arm 75A back off of its electrical contact with the pad contact 75B. This occurs when the actuator arm 92 is in its final, end position in the maximum clockwise rotation of the rotary shaft 8.

On the other side of the second panel 7 there is included a rotatable dome & fluorescent contactor structure 93 scrubbing against the switch circuit planar surface 74. The latter contactor structure 93, which integrally includes the dome and fluorescent contactor arms 94 & 95, respectively, and the central contactor hub 93A, is rotated conjunctively with but electrically isolated from the rheostat contactor arm 91 and the detent and plunger actuator arm 92. The central contactor hub 93A, which can have one or more contacting dimples on its underside, always remains in grounding, electrical contact with the central grounding hub plate portion 79A.

When the rotary shaft 8 begins in its starting or maximum counter-clockwise position, which is when the actuator arm 92 is positioned right in front of the detent protrusion 72A, the dimpled, distal end of the dome contactor arm is in contact with the dome pad 76 and the fluorescent contactor arm 95 is in contact with the fluorescent pad 77. As the shaft 8 is rotated clockwise a bit further, the actuator arm 92 is positioned between the detent protrusions 72A & 72B, at which position the dimpled, distal end of the dome contactor arm 94 is no longer in contact with the dome pad 76, opening its associated circuit, while the fluorescent contactor arm 95 still remains in contact with the fluorescent pad 77, maintaining its associated circuit closed.

As the main shaft 8 is rotated still further, so that the contactor arm 92 passes the second detent protrusion 72B, neither contactor arm 94, 95 is in contact with its respective pad 76, 77, both associated circuits thus being open or broken. For the remainder of the approximately three hundred and fifteen degrees of clockwise rotation, the rotatable switching structure 93 plays no further role. However, of course, the rheostat contactor arm 91 continues to serve to dim the panel lights, until it and the actuator arm 92 reach their final, maximum clockwise positions, cutting the main panel lights out completely and breaking the "dome" override or bypass circuit, respectively, as the actuator arm 92 passes the final detent protrusion 72C.

This breaking and making of the various circuits causes the supplemental fluorescent panel light and the dome light to be turned "off" and "on" due to the way the various electrical elements are wired together, all as shown generally in the switch circuit schematic of FIG. 8.

Additionally, these foregoing, relative positions of the various rotatable parts and operative or functional locations are further detailed in FIG. 1A.

As can be seen in the drawings, particularly FIGS. 2–4, the rotatable arms 91 & 92 with the hub 90, the rotatable switching structure 93 and the two panels 6 & 7 are all located within the front bracket area 4 of the main, overall switch body 1.

Exemplary insulating materials for the front panel 6 is a ceramic and for the back panel 7 a polymer.

It should be understood that, although the preferred, exemplary embodiment has been described with respect to switches controlling the "on"/"off" functions of the vehicle's dome light and the supplemental fluorescent light for the instrument panel, the principles of the present invention can be applied as well to other vehicle lights or other electrical components or functions, as desired.

Additionally, as mentioned above, the three operative surfaces could be switched around or even partially or fully combined, as may be desired for enhanced compactness.

Although this invention has been shown and described with respect to a detailed, exemplary embodiment thereof, it should be understood by those skilled in the art that various changes in form, detail, methodology and/or approach may be made without departing from the spirit and scope of this invention.

Having thus described at least one exemplary embodiment of the invention, that which is new and desired to be secured by Letters Patent is claimed below.

We claim:

1. In a composite, automotive push-pull, rotary switch structure for a headlight switch and at least tow other electrical switch functions for a vehicle, which switch structure includes longitudinally in line a basic push-pull switching component for the vehicle's headlights, a rheostat having a connection to a main, rotary shaft rotatable by the user to dim and brighten an electrical light, such as, for example, the panel light, and a front bracket area, the improvement comprising:

a flexible, rotatable detent arm;

a rotatable rheostat contactor arm;

a rotatable switching structure, said rotatable arms and said switching structure mounted for common rotary movement together in conjunction with the rotary shaft;

at least one panel having three, spaced, parallel, laterally extended, operative planar surfaces associated with it;

a rheostat planar surface including a rheostat having circularly disposed resistance means for varying the amount of resistance put into a circuit by the rheostat to brighten and dim the vehicle light in cooperation with said rotatable rheostat arm rotatably sweeping across it;

a detent planar structure including a series of raised protrusions, which serve as detent positions for the rotary portion of the overall switch in cooperation with said flexible, rotatable detent arm rotatably sweeping across it; and a switch circuit planar surface having spaced conductive surfaces and contacts which control the other electrical functions; said rotatable arms, said rotatable switching structure and said panel all being located within the front bracket area of the composite switch structure.

2. The composite automotive push-pull, rotary headlight switch structure of claim 1, wherein there is further included:

a second panel, said switch circuit planar surface being located on one side of said second panel, and at least one of the remaining two operative planar surfaces being located on the opposite side of said second panel.

3. The composite automotive push-pull, rotary headlight switch structure of claim 2, wherein there is further included:

relatively movable contacts located on said switch circuit surface controlling one of said other electrical functions; and a reciprocating member extending through said second panel, said reciprocating member being contactable and depressible by the contacting action of one of said rotatable arms as it is rotated, such contacting action causing said reciprocating member to move and change the state of the open and closed conditions of said relatively movable contacts.

4. The composite automotive push-pull, rotary headlight switch structure of claim 1, wherein said rheostat surface is a flat surface having a series of separate resistive layers circularly spaced and disposed about the center-line axis of rotation of the rotary shaft.

5. The composite automotive push-pull, rotary headlight switch structure of claim 4, wherein there is included on the same panel as said rheostat surface but on the side opposite thereto a laterally extended heat sink for dissipating the heat generated by the rheostat during its light dimming use.

6. The composite automotive push-pull, rotary headlight switch structure of claim 2, wherein the two panels are parallel and spaced from but face one another, said rheostat surface being on one facing side of one of said panels, and said detent surface being on the facing side of the other of said panels.

7. The composite automotive push-pull, rotary headlight switch structure of claim 6, wherein there is further included:

a hub of electrically insulating material, both of said rotatable arms and said rotatable switching structure being carried by said hub for common rotation together with the rotary shaft, said rheostat contactor arm and said rotatable switching structure being electrically isolated from one another.

8. The composite automotive push-pull, rotary headlight switch structure of claim 7, wherein both of said rotatable arms are flexible and bear down against the facing sides with some flexible force in opposite, longitudinal directions as they are swept across their respective operative surfaces.

9. The composite automotive push-pull, rotary headlight switch structure of claim 1, wherein said rotatable switching structure includes:

a central grounding ring surrounding the center-line axis of rotation of the rotary shaft; and two contactor arms electrically integrated therewith and extending out therefrom contacting separate contact pads on said switch circuit surface for separately controlling two vehicular electrical functions as the rotatable switching structure is rotated.

10. The composite automotive push-pull, rotary headlight switch structure of claim 9, wherein there is further included with said switch circuit planar surface;

a central grounding ring portion surrounding the center-line axis of rotation of the rotary shaft in constant electrical contact with said central grounding ring on said rotatable switching structure.

11. In a composite, automotive push-pull, rotary switch structure for a headlight switch and at least two other electrical switch functions for a vehicle, which switch structure includes longitudinally in line a basic push-pull switching component for the vehicle's headlights, a rheostat having a connection to a main, rotary shaft rotatable by the user to dim and brighten an electrical light, such as, for example, the panel light, and a front bracket area, the improvement comprising:

a flexible, rotatable detent arm;

a rotatable rhoestat contactor arm;

a rotatable switching structure, said rotatable arms and said switching structure mounted for common rotary movement together in conjunction with the rotary shaft;

a hub of electrically insulating material, both of said rotatable arms and said rotatable switching structure being carried by said hub for common rotation together with the rotary shaft, said rheostat contactor arm and said rotatable switching structure being electrically isolated from one another;

two, parallel, spaced facing panels, a first panel and a second panel, collectively having three, spaced parallel, laterally extended, operative planar surfaces associated with them;

a rheostat planar surface including a rheostat having circularly disposed resistive means for varying the amount of resistance put into a circuit by the rheostat to brighten and dim the vehicle light in cooperation with said rotatable rheostat arm rotatably sweeping across it;

a detent planar surface including a series of raised protrusions, which serve as detent positions for the rotary portion of the overall switch in cooperation with said flexible, rotatable detent arm rotatably sweeping across it; said rheostat surface being on one facing side of said first one of said panels, and said detent surface being on the facing side of said second one of said panels, both of said rotatable arms being flexible and bearing down against the facing sides with some flexible force in opposite, longitudinal directions as they are swept across their respective operative surfaces; and a switch circuit planar surface having spaced conductive surfaces and contacts which control the other electrical functions, said switch circuit planar surface being located on the far side of said second one of said panels, and said detent surface being located on the opposite side of said second panel; said switch circuit surface further including relatively movable contacts located on said switch circuit surface controlling one of said other electrical functions; and a reciprocating member extending through said second panel, said reciprocating member being contactable and depressible by the contacting action of said rotatable detent arm as it is rotated, such contacting action causing said reciprocating member to move and change the state of the open and closed conditions of said relatively movable contacts;

said rotatable arms, said rotatable switching structure and said panel all being located within the front bracket area of the composite switch structure.

12. The composite automotive push-pull, rotary headlight switch structure of claim 11, wherein said rheostat surface is a flat surface having a series of separate resistive layers circularly spaced and disposed about the center-line axis of rotation of the rotary shaft;

13. The composite automotive push-pull, rotary headlight switch structure of claim 12, wherein there is included on the same panel as said rheostat surface but on the side opposite thereto a laterally extended heat sink for dissipating the heat generated by the rheostat during its light dimming use.

14. The composite automotive push-pull, rotary headlight switch structure of claim 11, wherein said rotatable switching structure includes:

a central grounding ring surrounding the center-line axis of rotation of the rotary shaft; and two contactor arms electrically integrated therewith and extending out therefrom contacting separate contact pads on said switch circuit surface for separately controlling two vehicular electrical functions as the rotatable switching structure is rotated.

15. The composite automotive push-pull, rotary headlight switch structure of claim 14, wherein there is further included with said switch circuit planar surface:

a central grounding ring portion surrounding the center-line axis of rotation of the rotary shaft in constant electrical contact with said central grounding ring on said rotatable switching structure.

* * * * *